US007549191B2

(12) United States Patent
Seasholtz et al.

(10) Patent No.: US 7,549,191 B2
(45) Date of Patent: Jun. 23, 2009

(54) GUTTER CLEANING BLOWER VACUUM ATTACHMENT APPARATUS

(75) Inventors: Craig A. Seasholtz, Avis, PA (US); Cory F. Girton, Jersey Shore, PA (US)

(73) Assignee: Shop Vac Corporation, Williamsport, PA (US)

( * ) Notice: Subject to any disclaimer, the term of this patent is extended or adjusted under 35 U.S.C. 154(b) by 522 days.

(21) Appl. No.: 10/994,443

(22) Filed: Nov. 22, 2004

(65) Prior Publication Data

US 2006/0117671 A1 Jun. 8, 2006

(51) Int. Cl.
*A47L 9/00* (2006.01)

(52) U.S. Cl. ..... 15/414; 52/749.1; 15/321; 15/322

(58) Field of Classification Search ..... 52/749.1; 15/339, 348, 383, 92, 23, 406, 410, 414, 15/330, 320, 321, 322, 384
See application file for complete search history.

(56) References Cited

U.S. PATENT DOCUMENTS

| | | | | | |
|---|---|---|---|---|---|
| 1,661,480 | A | * | 3/1928 | Keefer | 15/321 |
| 2,623,234 | A | | 12/1952 | Brown | |
| 3,023,971 | A | * | 3/1962 | Milhous | 401/137 |
| 3,041,655 | A | * | 7/1962 | Entler | 401/263 |
| 3,908,910 | A | * | 9/1975 | Detwiler | 239/280 |
| 3,942,217 | A | * | 3/1976 | Bates | 15/321 |
| 3,971,098 | A | | 7/1976 | Davis | |
| 4,121,320 | A | | 10/1978 | Feiner | |
| 4,123,818 | A | * | 11/1978 | Hurwitz | 15/321 |
| 4,168,559 | A | * | 9/1979 | Henson | 15/23 |
| 4,182,497 | A | * | 1/1980 | Ferreira et al. | 239/532 |
| 4,195,209 | A | * | 3/1980 | Mlyniec | 200/83 R |
| 4,226,000 | A | * | 10/1980 | Tribolet | 15/321 |
| 4,270,238 | A | | 6/1981 | Shallenberg et al. | |
| 4,304,498 | A | * | 12/1981 | George | 401/9 |
| 4,319,851 | A | | 3/1982 | Arthur | |
| 4,333,203 | A | * | 6/1982 | Yonkers | 15/321 |
| 4,363,335 | A | | 12/1982 | Tapper | |

(Continued)

FOREIGN PATENT DOCUMENTS

| | | |
|---|---|---|
| DE | 4321669 | 1/1995 |

(Continued)

OTHER PUBLICATIONS

Written Opinion of the International Searching Authority issued in PCT/US2005/027271, dated May 31, 2007 (8 pages total).

*Primary Examiner*—Richard E Chilcot, Jr.
*Assistant Examiner*—Chi Q Nguyen
(74) *Attorney, Agent, or Firm*—Marshall, Gerstein & Borun LLP

(57) ABSTRACT

A water jet-assisted blowing and vacuum apparatus for cleaning gutters having a curved end attachment member for connection to an elongated air conduit to reach into gutter areas, and a pressurized water nozzle mounted to the air conduit curved end member and oriented to loosen gutter debris adjacent the operating free end of the curved end attachment member. The water nozzle can be mounted internally or externally of the curved end attachment member, as well as positioned so as to be removed from or closely adjacent to the operating end of the curved end attachment member.

20 Claims, 10 Drawing Sheets

U.S. PATENT DOCUMENTS 4,397,057 A * 8/1983 Harbeck ..... 15/321
4,402,106 A 9/1983 Mattson
4,534,083 A * 8/1985 Hampson ..... 15/321
4,718,613 A 1/1988 Moomaw
4,756,043 A * 7/1988 Hazelet ..... 15/104.16
5,037,028 A 8/1991 Evans
5,054,159 A 10/1991 Richardson
5,056,187 A 10/1991 Higgins
5,195,209 A 3/1993 Watkins
5,289,611 A * 3/1994 Yonkers et al. ..... 15/321
5,386,942 A * 2/1995 Dietle ..... 239/532
5,555,597 A * 9/1996 Berfield ..... 15/321
5,586,360 A 12/1996 Diederiks, Jr. et al.
5,727,580 A * 3/1998 Patterson ..... 134/115 R
5,855,402 A 1/1999 Maraschiello
6,139,077 A * 10/2000 Molzan, II ..... 294/19.1
6,185,782 B1 2/2001 Hall
6,257,256 B1 7/2001 Fischer
6,519,809 B2 2/2003 Gutry
6,766,560 B2 * 7/2004 Murphy ..... 15/414
2004/0020516 A1 2/2004 Buckner
2004/0107532 A1 6/2004 Murphy

FOREIGN PATENT DOCUMENTS

EP 08193396 7/1996

* cited by examiner

GUTTER CLEANING BLOWER VACUUM ATTACHMENT APPARATUS

FIELD OF THE INVENTION

This invention relates to gutter cleaning devices, and more particularly to a water-assisted blower and vacuum attachment for use in gutter cleaning.

BACKGROUND OF THE INVENTION

Numerous different devices are known for cleaning rain gutters and gutter systems. These include vacuum and pressurized air-type devices typified by U.S. Pat. Nos. 3,971,098; 4,402,106; 5,586,360; and 6,519,809, and water-pressure and water-delivery-type devices typified by U.S. Pat. Nos. 4,363,335 and 5,037,028. There are also mechanical gutter cleaning devices such as typified by U.S. Pat. Nos. 4,319,851; 4,718,613 and 5,855,402. The vacuum-type devices have no provision for washing down the gutter troughs after the leaves and other debris have been removed, the latter done by such methods as scraping, blowing or vacuuming. That is, the vacuum-type devices have no capability of using a water jet to blast loose the accumulated leaf debris in a gutter. On the other hand, the water-type devices have no provision for assuring substantial removal of the debris, whether by blowing or vacuuming of it, once a pressurized water jet is used to dislodge the same.

There has been a need for a gutter cleaning apparatus that provides sufficient impact force to dislodge and loosen encrusted leaves and other debris found in a roof gutter, while additionally being able to remove such dislodged debris.

SUMMARY OF THE INVENTION

The present invention in one aspect provides a curved end elbow-like attachment member operable to connect to an elongated blower and vacuum air conduit to reach elevated gutter areas, coupled with a pressurized water nozzle mounted to the curved end attachment member. The water jet provides sufficient water force to dislodge encrusted leaves and other debris from a gutter, while the blowing (or alternatively the vacuum) capability of the curved end attachment member permits ready blowing (or vacuum) removal of that now-dislodged leaf debris.

The curved end attachment member can take the form of a plastic extruded or injection molded curved member, capable of attachment at one end to an existing elongated blower or vacuum air conduit, while at the other end having a free operating end, usable for blowing or vacuuming of forced air. Further, the pressurized water jet can take the form of a water conduit connected to the elongated air conduit, as well as to the curved end attachment member. More specifically, the water supply hose can be fastened to both the elongated air conduit as well as the curved end attachment member. That hose can either be mounted internally or externally of the curved end attachment member. Additionally, the pressurized water nozzle for the water supply hose can be mounted at the terminal end of the curved end attachment member, somewhat removed from that terminal end, or even more substantially removed from that terminal end, such that the pressurized water jet can exit through the same conduit as the blowing (or vacuum) air, or can even be mixed with the blowing (or vacuum) air for delivery to the encrusted gutter debris. In the latter case, the blowing air helps to increase the velocity, and hence the blasting and cleaning effect, of the water.

In an alternate arrangement, the elongated air conduit and the curved end attachment member can be separately fitted with, or integrally formed with, hose grip members, for detachably retaining the hose along the exterior of such air conduit and curved end attachment member.

BRIEF DESCRIPTION OF THE DRAWINGS

The foregoing and other aspects of the present invention are illustrated in the following drawings, in which.

DETAILED DESCRIPTION OF THE INVENTION

Figure 1:
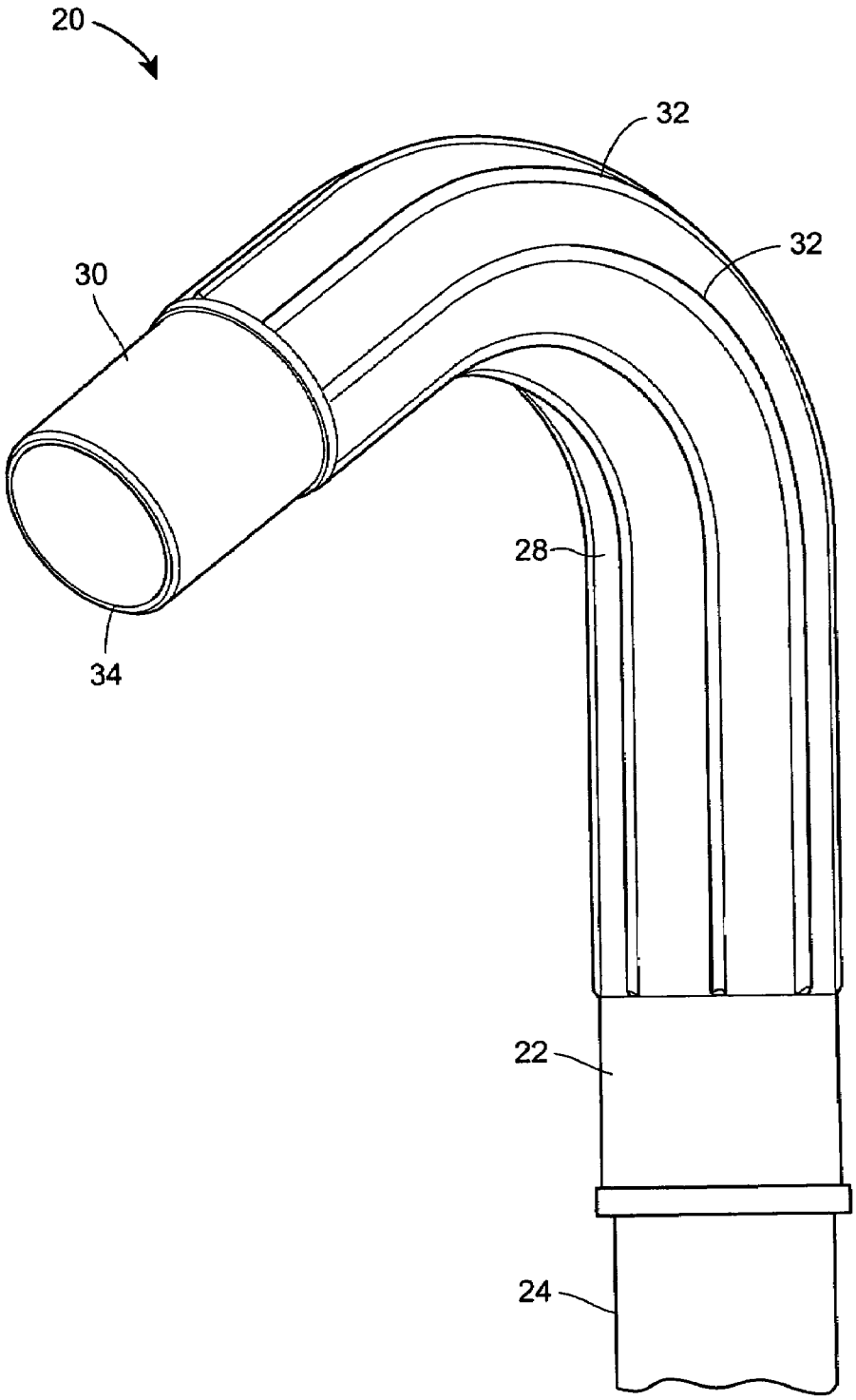
FIG. 1 is a perspective view of the curved end attachment member of the present invention.
Figure 2:
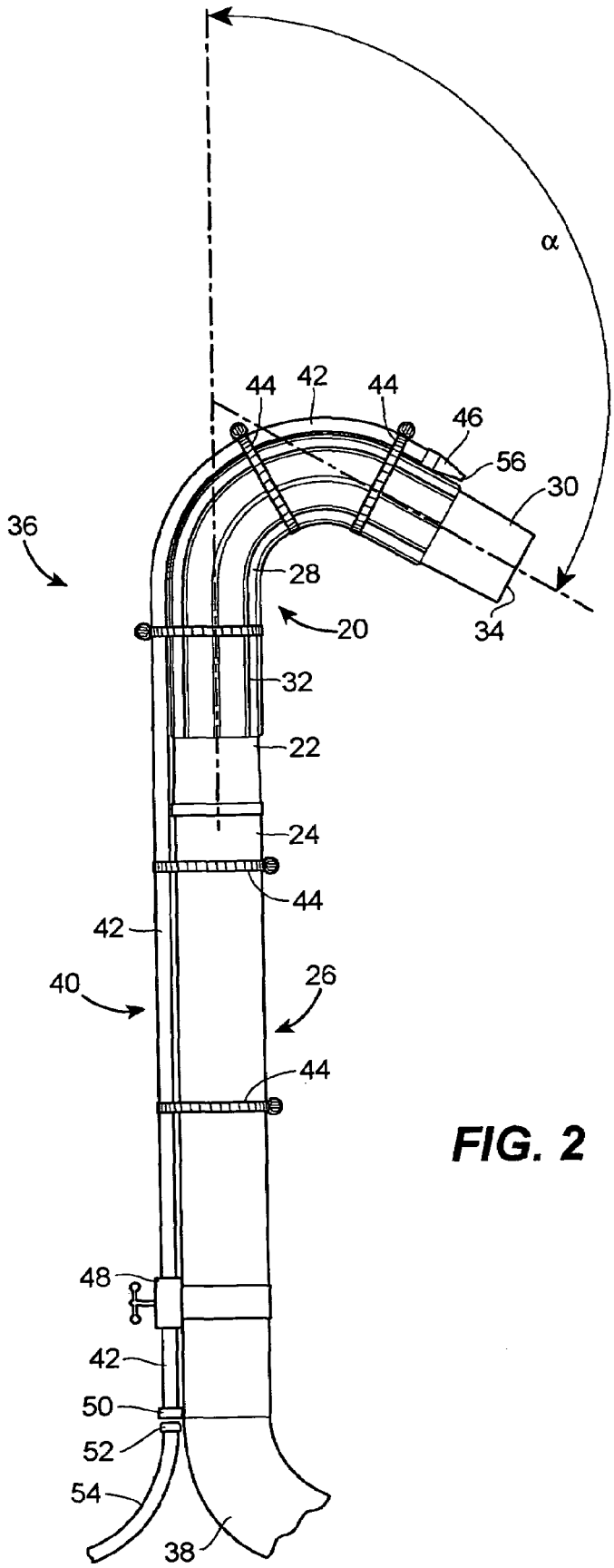
FIG. 2 is a side elevation view of a first embodiment of the present invention, depicting the curved end attachment member connected to an elongated air conduit, and the associated water pipe end nozzle.

As shown in FIGS. 1 and 2 of the drawings, in which similar elements are depicted by like reference numbers, a curved end elbow-like attachment member is generally denoted by reference numeral 20. Curved end member 20 is preferably formed of a blow-molded plastic material, such as HDPE (high density polyethylene), and includes a connector end 22 for friction fit engagement with the uppermost end 24 of an elongated blowing or vacuum air conduit 26 (see FIG. 2). Curved end member 20 also includes an elongated central curved section 28 with an operating end 30 terminating in a free end 34. It will be seen that ribs 32 formed on the exterior surface of central curved segment 28 cooperate to provide rigidity and strength to the curved end attachment member 20. The curved end member 20 can be formed of other materials, and by other manufacturing methods, for example, by injection-molding.

As best seen in FIG. 2, the angle a (defining the angle between the collectively upright alignment of the connector end and beginning of central curved segment 28 versus the alignment of the outermost portion of central segment 28 and free end 30) can fall within the range from approximately 90° to 170°, but is preferably approximately 120°. Preferably, the inside diameter of the opening of the free operating end 34 is approximately 2.075 inches, to work with the common commercially available forced air hoses, but it will be understood that other sizes can be readily utilized for end 34.

Continuing with FIG. 2, there is shown a combination water jet and blowing assembly for cleaning gutters, generally denoted by reference numeral 36. As seen, connector end 22 of the curved end attachment member 20 connects to an elongated blowing (or vacuum) air conduit 26, which in turn connects (at its lower end in FIG. 2) to a pressurized air hose 38 leading to a pressurized air source (not shown). Air conduit 26 is preferably made of a suitably strong tubular material, such as a blow-molded or injection molded plastic material, so as to withstand wear and tear, and additionally to provide sufficient rigidity and strength for handling, the latter so as to properly maneuver, at an elevated overhead position within a gutter assembly (not shown), the free operating end 34 of the curved end member 20.

Further, a pressurized water hose supply, generally denoted by reference numeral 40, is mounted to the rear side of the elongated air conduit 26, and along the back and across the top of the curved end member 20. More specifically, the water hose assembly 40 includes a water hose segment 42 mounted to the rear of the air conduit 26 and of curved end member 20 by way of retainer means 44, shown in the drawings as band clamps, and terminating in a water nozzle 46. The other end of water hose segment 42 includes a positive shut off valve member 48 and a terminal female connector end 50 operable to connect to the male end 52 of the suitable pressurized water supply line 54. It will be noted that the connectors 44 will preferably be either metal or plastic band clamps, but could also be in the form of plastic or metal wire tie members (not shown). Further, the shut-off valve can take, for example, the form of a rotary type sill cock valve, or a pinch clamp or squeeze valve. The water hose 42 can be formed as a section of common garden hose, or as a section of clear flexible tubing material, or even as a harder, extruded or injection-molded plastic tubular segment.

In operation, the combination water jet and blowing apparatus assembly 36 is manipulated so that the free operating end 34 of curved end attachment member 20 is placed within a gutter system needing cleaned (not shown). In one aspect, the blowing (or vacuum air) source, via hose 38, is initiated, whereby either blowing or vacuum air operates through the free end 34 of curved member 20 to remove dislodged leaves and other debris residing in the gutter. Thereafter, once the forced air being supplied by hose 38 is discontinued, the hose shut off member 48 can be activated, whereby pressurized water supplied by line 54 moves through the water hose assembly 40, and exits in a blasting-type water jet stream exiting from the water nozzle 46. That water jet operates to dislodge any leaves, debris, shingle fines, and other undesirable material that has accumulated within the gutter. Whereupon, if desired, the pressurized water via line 54 can be discontinued (by turning off the hose shut off 48), and the forced air reinitiated through supply line 38, whereby the remaining debris in the gutter can be removed by forced air operating through free end 34. It will be understood that either water pressure or forced air can be initiated first, and then the other, separately, or in combination, as desired, and repeated as much as needed.

Figure 2A:
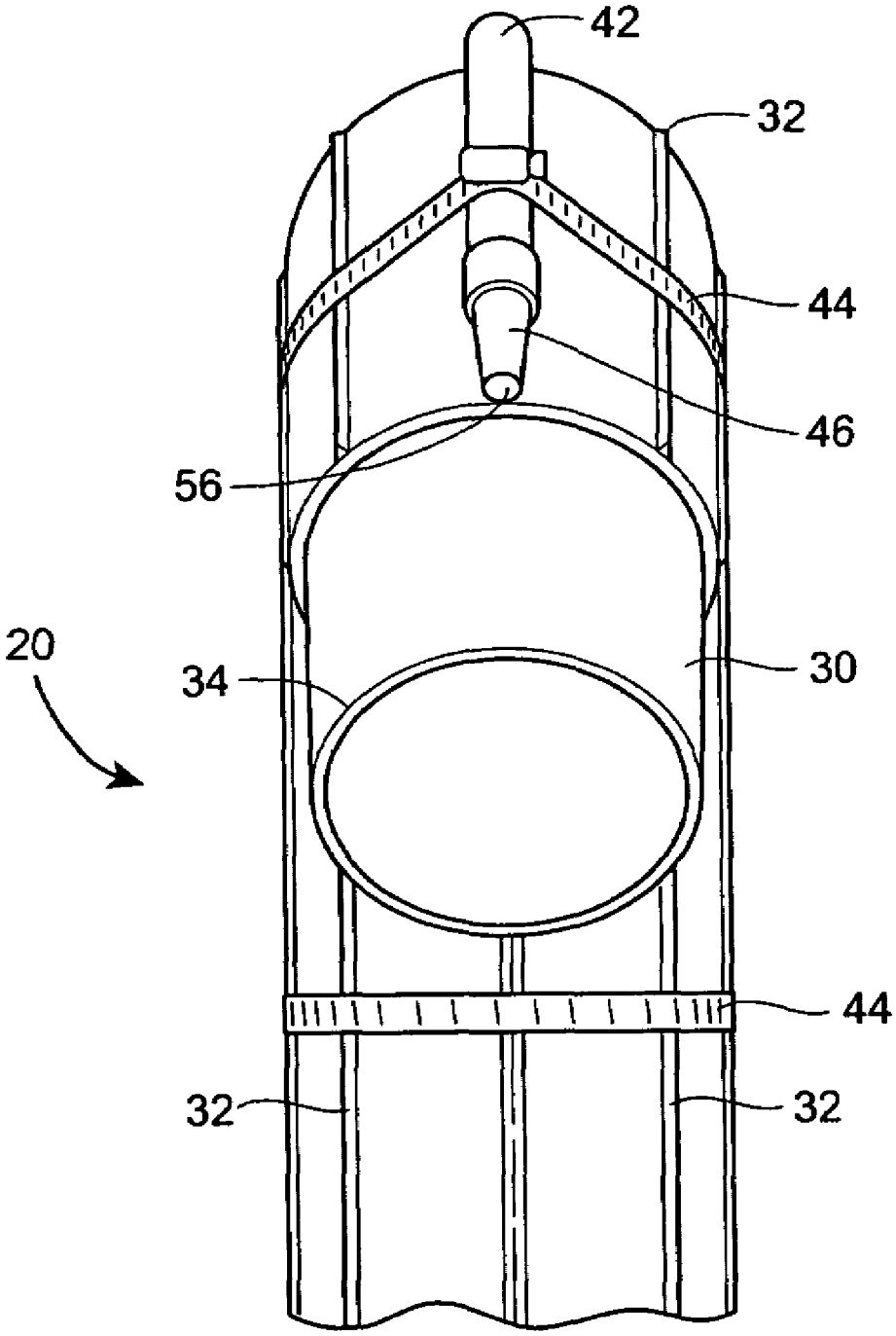
FIG. 2*a* is a front perspective view of the upper portion of the embodiment shown in FIG. 2.
Figure 2B:
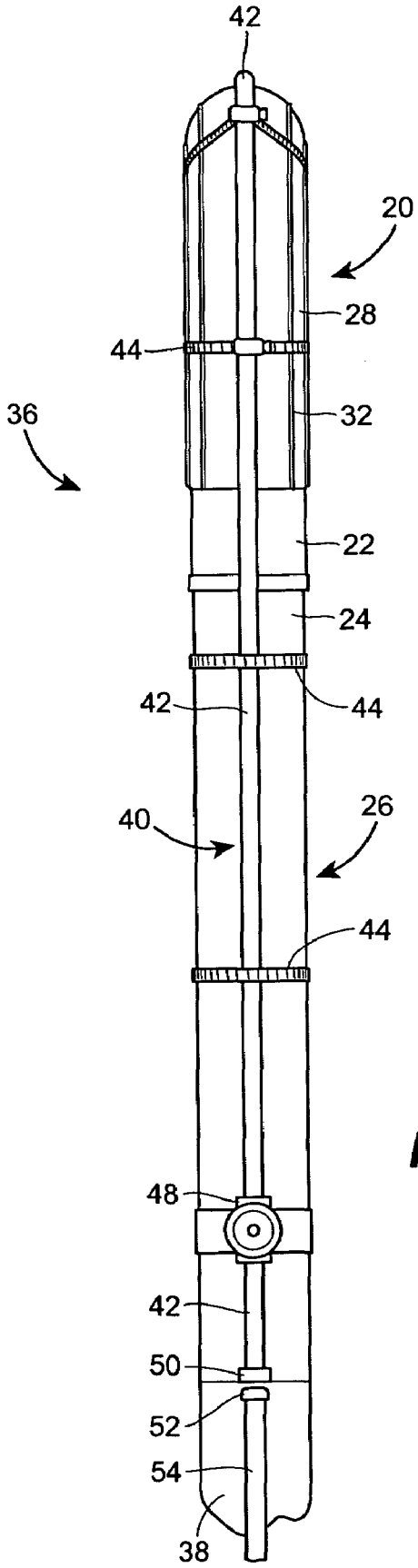
FIG. 2*b* is a rear elevation view of the embodiment shown in FIG. 2.

It will be understood that, instead of having the tip 56 of water nozzle 46 terminate approximately adjacent the outer terminal ends of the rib 42 of curved member 20 (as seen in FIGS. 2 and 2*a*), that tip end 56 could alternatively be positioned so as to terminate adjacent the outer free end 34 of curved member 20. However, the nozzle tip 56 is preferably positioned as shown in FIG. 2, to minimize the chance that any significant amount of gutter debris can be potentially jammed into the tip end 56 and thus clog the same.

Figure 3:
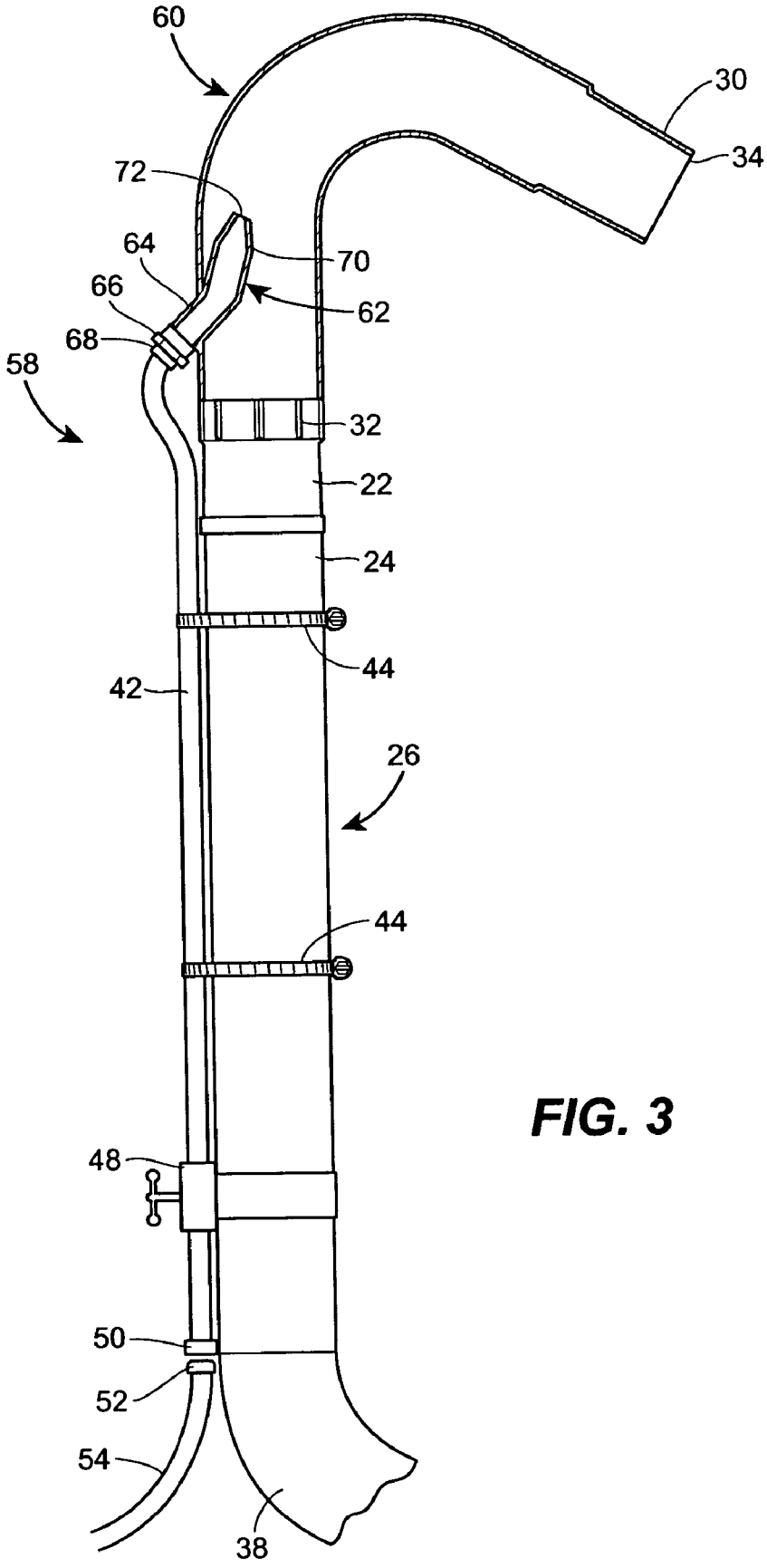
FIG. 3 is a side elevation view of an alternate embodiment of the present invention, with the upper curved end attachment broken away for better viewing, and depicting the placement for the water jet nozzle.

In another aspect of the invention, there is depicted in FIG. 3 a modified version of the present invention, wherein a combination water jet and forced air apparatus assembly 58 is shown. Common elements in this alternate embodiment relative to the first embodiment shown in FIG. 2, bear common reference numerals.

In this embodiment, the curved end attachment member, generally denoted by reference numeral 60, is slightly modified in that, while otherwise the same as curved end attachment member 20 of the first embodiment, it has a specially-configured, integrally-formed water jet nozzle 62. More specifically, modified water jet nozzle 62 includes an exteriorly-extending portion 64 having a female connector 66 operable to accept a male connector 68 of the water hose segment 42. Additionally, there is an internally-extending, angularly-canted water jet nozzle portion 70 having a tip end 72 that points upwardly towards the upper curved interior of curved end attachment member 60.

In the operation of modified assembly 58, instead of having the water jet presented at an exterior location relative to terminal end 34, the water jet emerges from the interior of modified curved attachment member 60, via the interiorly-positioned water nozzle 70, and thus exits through the free operating end 34 (when assembly 58 is being operated in the water jet operation mode). Otherwise, when the shut off valve 48 has been put in the off position, such that water no longer exits through internally positioned nozzle tip end 72, any forced air supplied via hose 38 operates to blow away (or vacuum up) gutter leaf debris via free operating end 34, just as done with the first embodiment (of FIG. 2). Alternatively, both the forced air and water jet can be operated simultaneously, whereby the blowing air acts to increase the speed, and hence the delivered pressure of the combined blasting water and air jets, i.e. as a combined high-velocity mixture, to best dislodge and remove the gutter debris.

Figure 4:
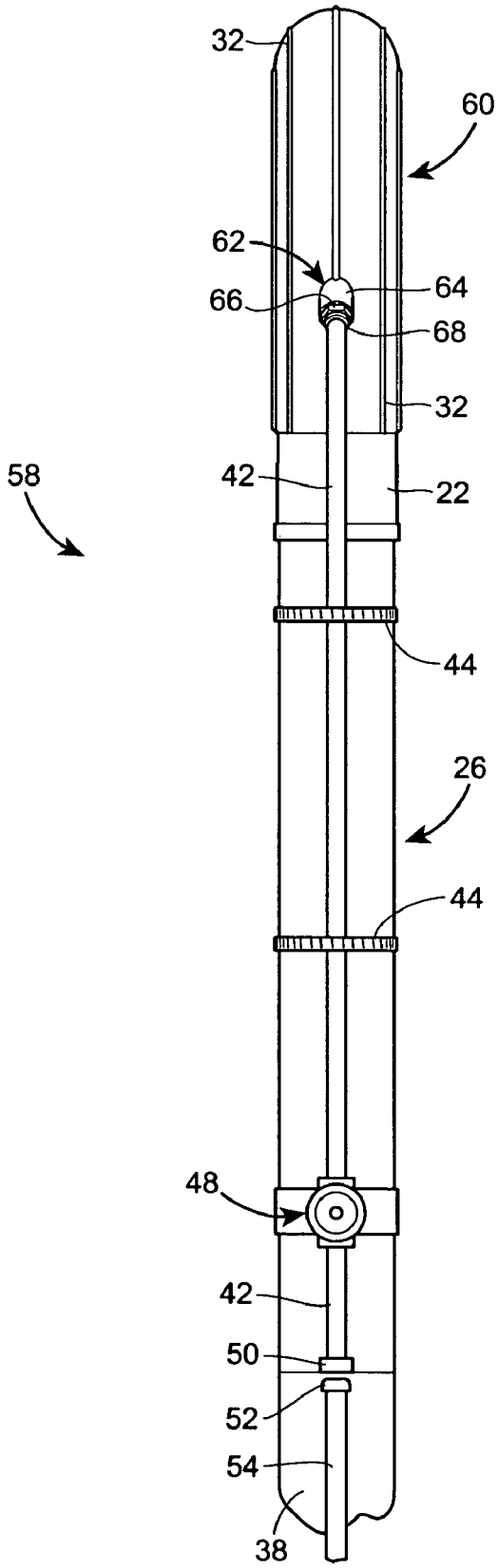
FIG. 4 is a rear elevation view of the embodiment shown in FIG. 3.

It will be seen that one advantage of assembly 58 of this second embodiment, as shown in FIGS. 3 and 4, is that the water hose segment 42 only need be fastened, via band clamp fasteners 44, to the elongated air conduit 26. This is because the male end 68 of hose 42 threadably connects to the female end 66 of the water jet nozzle 62, and is supported thereby. Thus, there is no need to have any band clamp fastener 44 used with hose 42 along the modified curved end attachment member 60. Further, because the nozzle tip end 72 is internally positioned in curved end 60, and also substantially remote from the operating end 34, there is less chance for tip end 72 to be in any direct contact with leaves and other debris deposited in gutters, during normal operation and use.

Alternatively, it will be understood that, instead of having the water jet nozzle formed as an integral unit with the modified curved end attachment member 60 (per FIGS. 3 and 4), the water jet nozzle 62 could be a completely separate item (not shown) that is inserted into an opening formed in the back side of the modified curved end attachment member 60, and fastened there in place, such as by suitable gluing or otherwise.

Figure 5:
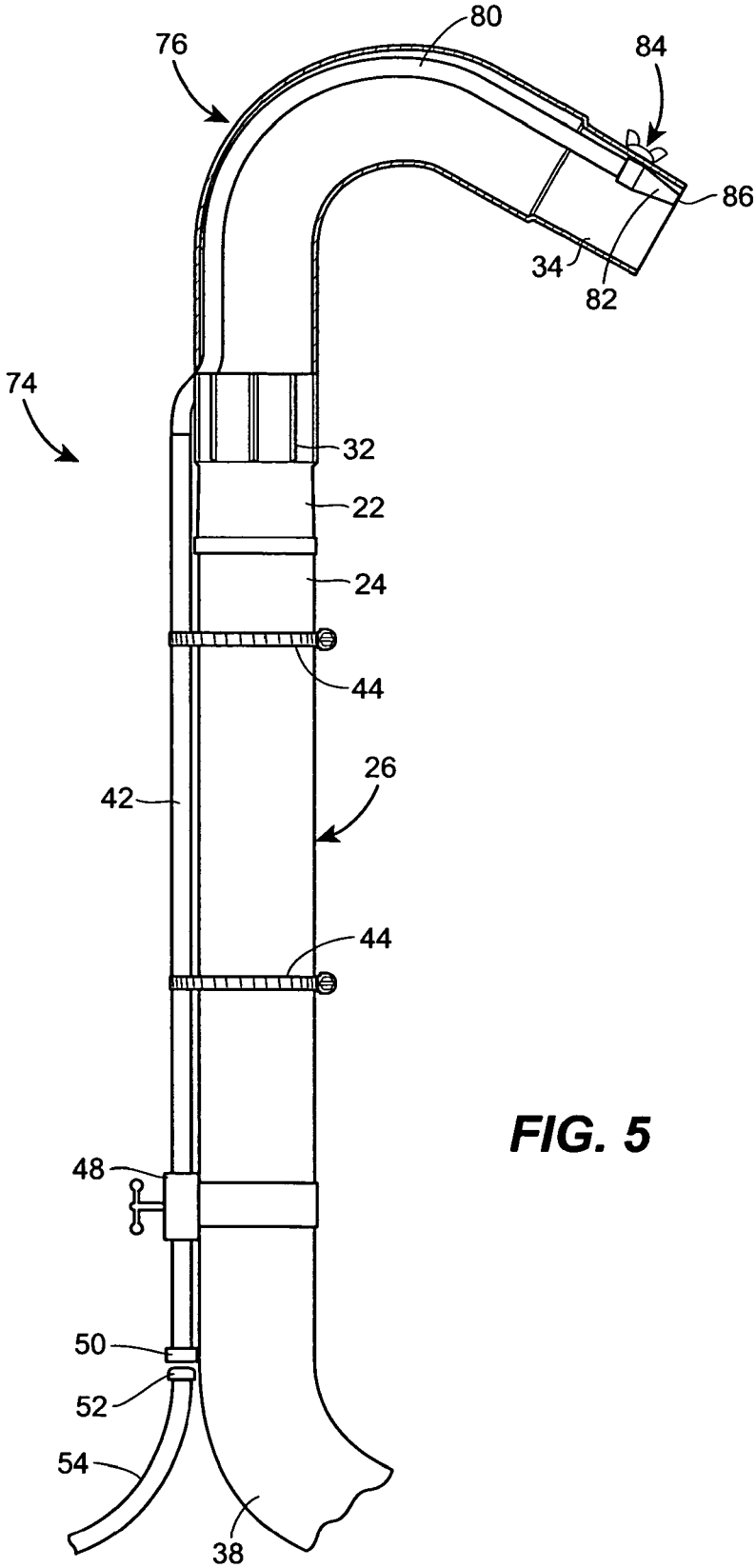
FIG. 5 is another alternate embodiment of the present invention, with the upper curved end section broken away for better viewing, and depicting the internal placement of the water hose and nozzle for the curved end portion.
Figure 6:
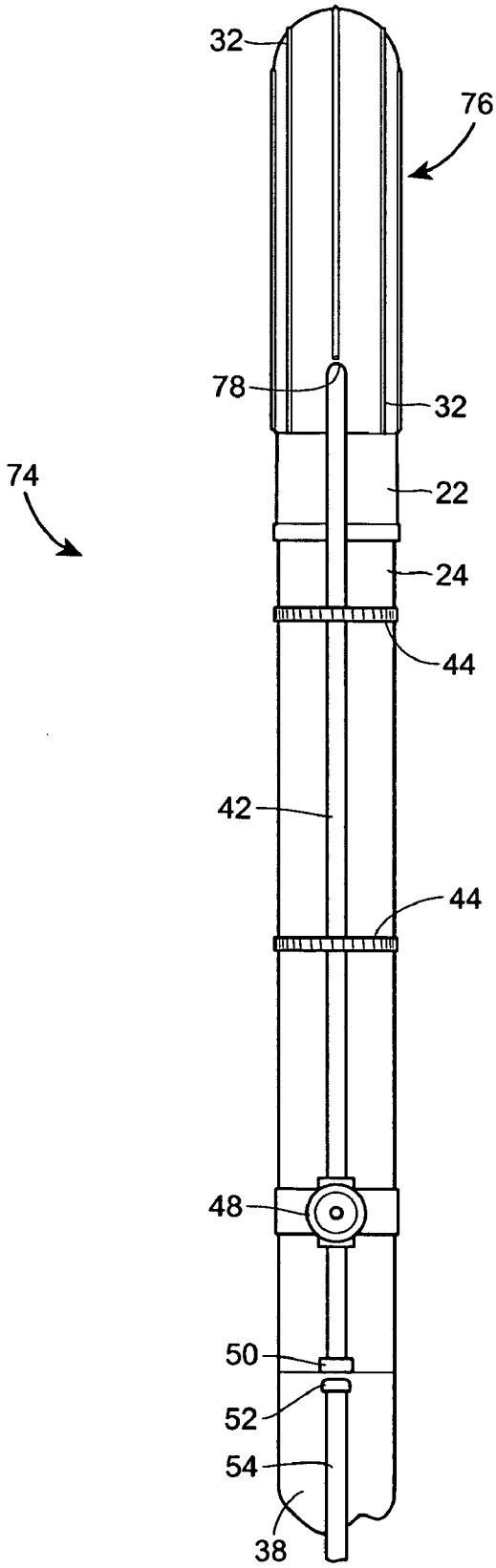
FIG. 6 is a rear elevation view of the embodiment shown in FIG. 5.

Turning now to FIGS. 5 and 6, there is shown yet another modified embodiment of the present invention, generally depicted as combination water jet and forced air apparatus assembly 74. Again, any structural elements in assembly 74 that are similar to ones used in the prior embodiments 36 and 58, bear the same reference numerals. Assembly 74 includes a modified curved end attachment member 76 having a rearward facing hose opening 78 through which the water hose segment 48 passes. In that manner, the terminal portion 80 of water hose 42 is located internally within the modified curved end attachment member 76. A water nozzle 82 is mounted to the outer terminal end 80 of water hose 40, and is maintained in place via a threaded fastener 84 mounted to the end 34 of modified curved end attachment member 76. Further, in this embodiment, the nozzle tip 86 is positioned so as to terminate approximately even with the outer free operating end 34 of modified curved attachment member 76. In this fashion, the water jet emerging from nozzle 82 is positioned as close as possible to the debris in the gutter members being cleaned.

Again, during operation, when the water jet is turned on, via hose shut off member 48, the stream of pressurized water exiting water nozzle 82 is presented from the internal end of free end 34, for blasting gutter debris. Then, when that pressurized water flow has ceased, by turning off the hose shut off 48, forced air (blowing or vacuum) can be sent through air conduit 26 to exit free operating end 34, so as to blow away (or vacuum up) the gutter leaf debris. Again, if desired by the end user, both the forced air and pressurized water streams can be operated at the same time.

Figure 5A:
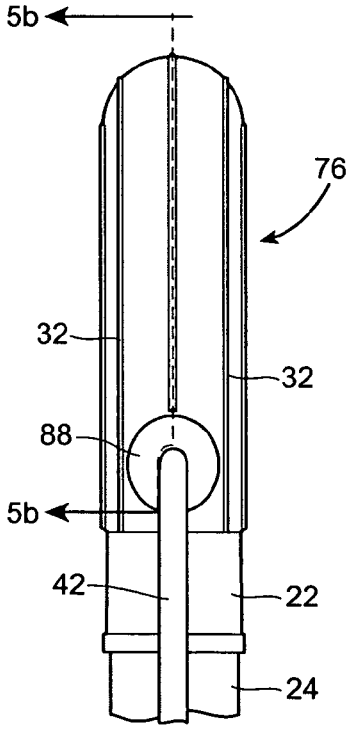
FIG. 5*a* is an enlarged section view depicting a sealing grommet for use with a water line.
Figure 5B:
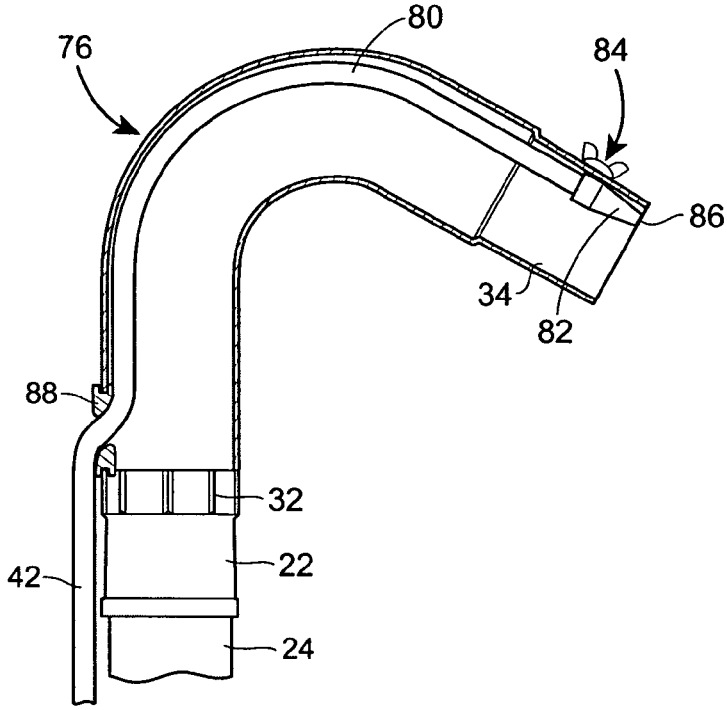
FIG. 5*b* is an enlarged side section view depicting the sealing grommet of FIG. 5*a;*

If preferred, a sealing grommet member 88 (see FIGS. 5*a* and 5*b*) can be used about water hose segment 42, as it passes through the hose opening 78 of curved end attachment member 76, so as to minimize any leakage of forced air about hose 42 at hose opening 78.

Again, unlike the first embodiment depicted in FIG. 2, the assembly 74 of this alternate embodiment (see FIGS. 5 and 6) eliminates the need for any additional band clamp members 44 along curved end attachment member 76, since the water hose terminal section 80 is maintained internally of the curved end attachment member 76. That is, hose section 80 can be held in place up against the inside of curved end member 20 by numerous methods, i.e. gluing, threaded fasteners, or clamps. In any event, whatever method is so used, the goal is to reliably retain the hose section 80, and nozzle 82, in place so as to prevent the pressurized water nozzle 82 from flailing about freely within member 76 during use. Further, if the tubing of hose section 80 is held so as to reside directly against the inner wall of curved end 20, then hose section 80 will restrict less forced air flow through curved end 20.

Figure 7:
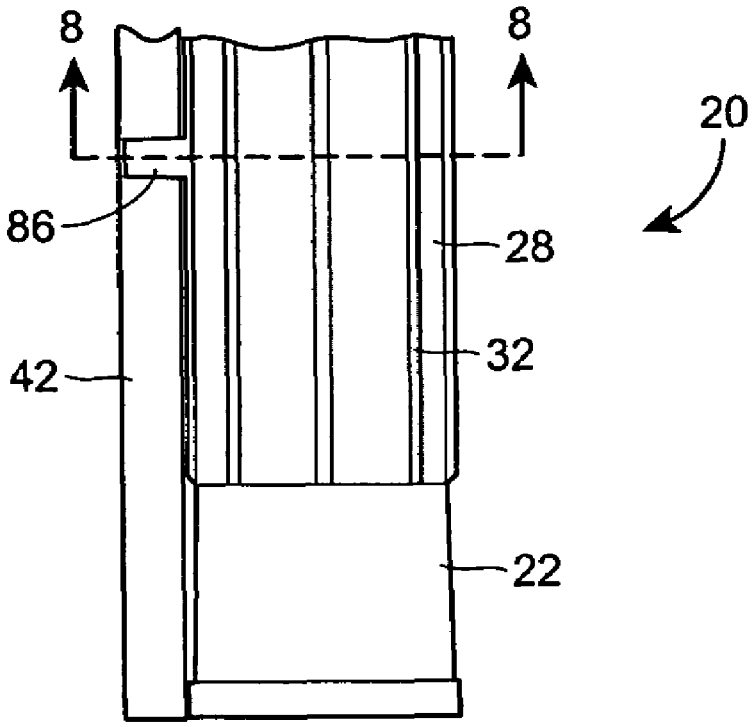
FIG. 7 is a side elevation view of an alternate form of attachment for the water conduit to the air conduit.
Figure 8:
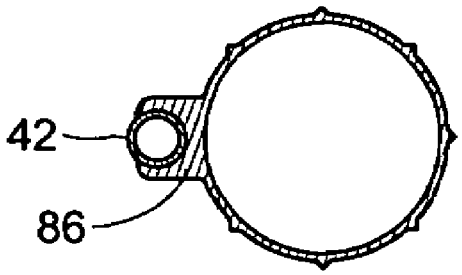
FIG. 8 is a cross-section view, taken along lines 8-8 in FIG. 7, of the alternate attachment structure.

Turning to FIGS. 7 and 8, there is shown an alternate means for attaching the water hose segment 42 to the rear side of the curved end attachment member 20, and along the curved middle segment 28. That is, instead of utilizing selectively positioned separate fasteners 44, such as wire ties or band clamps, for example, outwardly extending, U-channel-type grip elements 86 can be integrally formed with the conduit 26 and the curved end attachment member 20. Grip elements 86 can be formed to be of such an internal diameter as to readily grip and support, as desired, the water hose segment 42. In this way, via friction fit by such hose grip elements 86, the water hose 42 is snugly held in place along the back side of the conduit 26 and along curved end attachment member 20.

We claim:

1. A gutter cleaning apparatus, for use in cleaning debris in overhead elevated gutter areas, comprising:

an elongated conduit for supplying one of vacuum air and pressurized blowing air;

a water supply line connected to a water nozzle for providing a stream of pressurized water; and a curved end attachment member mounted at one end to the elongated conduit, and having at its other end a free operating end for delivering the vacuum air and blowing air, the curved end attachment member supporting the water supply line and water nozzle along a curved portion thereof, whereby the water nozzle is so positioned relative to the curved end attachment member such that selective manipulation of the curved end attachment member by the elongated conduit attached thereto causes selective manipulation of the stream of pressurized water provided by the water nozzle.

2. The apparatus of claim 1, wherein the water nozzle is positioned externally of the curved end attachment member.

3. The apparatus of claim 1, wherein the water nozzle is positioned internally of the curved end attachment member.

4. The apparatus of claim 1, wherein the water nozzle is positioned closely adjacent the free operating end of the curved attachment member.

5. The apparatus of claim 1, further comprising attachment members for attaching the water supply line to the elongated conduit.

6. The apparatus of claim 5, wherein the attachment members comprise one of band clamp members and wire ties.

7. The apparatus of claim 1, and wherein the water nozzle is integrally formed with the curved end attachment member.

8. The apparatus of claim 7, wherein the integrally formed water nozzle extends through the sidewall of the curved end attachment member such that the stream of pressurized water is positioned interiorly thereof.

9. The apparatus of claim 1, further comprising elongated rib members formed on the exterior of the curved end attachment member to provide strength thereto.

10. The apparatus of claim 9, wherein the exterior rib members are present only along the curved portion of the curved attachment member.

11. The apparatus of claim 1, further comprising a positive shut-off member connected to the water supply line for selectively providing pressurized water thereto.

12. The apparatus of claim 1, wherein the water supply line extends through an opening in the sidewall of the curved end attachment member, to permit the water nozzle to be mounted interiorly of the curved end attachment member.

13. The apparatus of claim 1, wherein the angle of curvature between the mounting end and the free and open operating end of the curved end attachment member is within the range of approximately 90° to approximately 170°.

14. A gutter cleaning device comprising:

an elongated tubular housing having an open end, curved portion, and a free and open operating end, the open end of the housing being attachable to a pressurized air source such that pressurized air is deliverable through the free and open operating end;

a water hose segment having a water nozzle and a water valve attachable to a pressurized water source such that pressurized water is deliverable through the water nozzle; and an attachment device for attaching the water hose segment to the elongated tubular housing, wherein the water nozzle of the water hose segment is positioned relative the curved portion of the elongated tubular housing such that manipulation of the elongated tubular housing causes manipulation of the pressurized water deliverable through the water nozzle.

15. The device of claim 14, wherein the attachment device attaches the water hose segment externally of the elongated tubular housing.

16. The device of claim 14, wherein the attachment device attaches the water hose segment internally of the elongated tubular housing.

17. The device of claim 14, wherein the water nozzle of the water hose segment is positioned closely adjacent the free and open operating end of the elongated tubular housing.

18. The device of claim 14, wherein the attachment device is integrally formed with the elongated tubular housing.

19. The device of claim 14, wherein the attachment device comprises at least one of a band clamp and a wire tie.

20. The device of claim 14, wherein the water hose segment extends through a side wall of the elongated tubular housing such that the water nozzle is positioned internally of the free operating end of the elongated tubular housing.

* * * * *

UNITED STATES PATENT AND TRADEMARK OFFICE

CERTIFICATE OF CORRECTION

PATENT NO. : 7,549,191 B2
APPLICATION NO. : 10/994443
DATED : June 23, 2009
INVENTOR(S) : Craig A. Seasholtz et al.

It is certified that error appears in the above-identified patent and that said Letters Patent is hereby corrected as shown below:

In the Claims:

At Column 8, lines 1-2, "free operating" should be -- free and open operating --.

Signed and Sealed this

Fifteenth Day of September, 2009

David J. Kappos

David J. Kappos
*Director of the United States Patent and Trademark Office*